United States Patent [19]

Bischofberger

[11] Patent Number: 4,532,759

[45] Date of Patent: Aug. 6, 1985

[54] METHOD AND APPARATUS FOR TIME-OPTIMIZING OCCURRENCE OF WORK AT INDIVIDUAL OPERATING POSITIONS OF TEXTILE MACHINES

[75] Inventor: Jürg Bischofberger, Elsau, Switzerland

[73] Assignee: Rieter Machine Works Ltd., Winterthur, Switzerland

[21] Appl. No.: 479,655

[22] Filed: Mar. 28, 1983

[30] Foreign Application Priority Data

Apr. 5, 1982 [CH] Switzerland ..... 2071/82

[51] Int. Cl.[3] ..... D01H 9/10; D01H 9/14; D01H 13/24; D01H 13/32

[52] U.S. Cl. ..... 57/264; 57/268; 57/276; 57/281; 57/300; 242/35.5 R; 242/35.5 A

[58] Field of Search ..... 57/264, 265, 266, 268, 57/276, 281, 300-302; 242/35.5 R, 35.5 A, 35.5 T

[56] References Cited

U.S. PATENT DOCUMENTS 4,283,908 8/1981 Kamp et al. ..... 57/276

FOREIGN PATENT DOCUMENTS 3030504 6/1981 Fed. Rep. of Germany ..... 57/264

2065725 7/1981 United Kingdom ..... 57/264

*Primary Examiner*—John Petrakes

*Attorney, Agent, or Firm*—Werner W. Kleeman

[57] ABSTRACT

On textile machines, on which packages are wound with a set or reference yarn length, the changing of these packages by means of a travelling package changing device should be carried out in such time optimized manner that the largest possible number of winding positions can be serviced by the package changing device. For this purpose, the yarn length of packages to be wound is signalled continuously to a computer by means of yarn length measuring units and the location of a package changer is continuously signalled to the computer by means of positioning units. If certain packages reach a remainder or residual yarn length before reaching the set yarn length, then the wind-up times for the remainder yarn length of these packages are compared by the computer with the respective travelling times of a package changer to these packages and registered in an optimization procedure, for example for three of these packages. For these three registered packages, the computer determines a package changing sequence in which the waiting times until package change of the individual packages are either equal to zero or at least as small as possible.

19 Claims, 8 Drawing Figures

Fig. 1
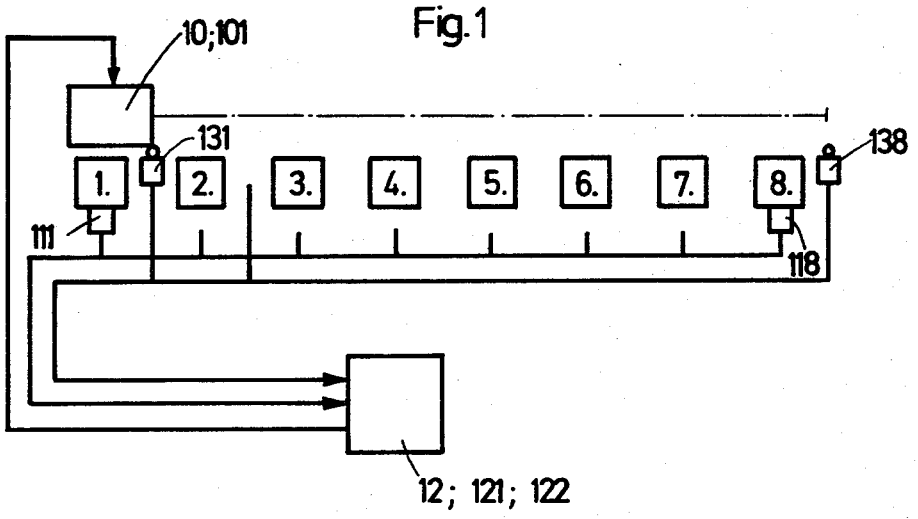
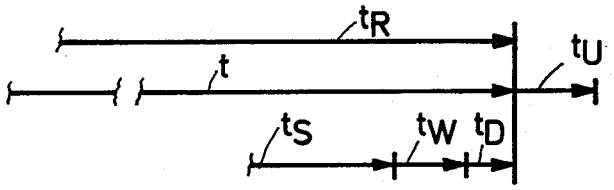
Fig. 2
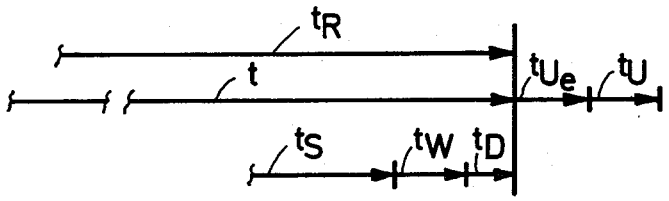
Fig. 6

METHOD AND APPARATUS FOR TIME-OPTIMIZING OCCURRENCE OF WORK AT INDIVIDUAL OPERATING POSITIONS OF TEXTILE MACHINES

BACKGROUND OF THE INVENTION

The present invention relates to a new and improved method and apparatus for time-optimizing the performance or occurrence of work at individual operating positions or stations of textile machines.

It is known that for packages which are used as feed material for the so-called warping process, a uniform wound length of yarn is desired, in order to avoid as far as possible losses through remnant or residual yarn lengths, which are no longer usable, on still not quite empty feed packages.

Uniformly wound yarn lengths can be achieved in an open-end spinning method, also referred to in the art as rotor spinning method, by measuring the yarn lengths during the winding operation or procedure by means of a length measuring unit and by interrupting the spinning process per spinning position for a package change operation when a predetermined set or reference yarn length is attained.

The package change procedure can be carried out manually, or by means of stationary package changing and yarn piecing devices which are provided per spinning position or location, or by means of appropriate devices travelling along the spinning positions.

The aforesaid manual variant is not only labor intensive, but demands from the attendant particular skill in yarn piecing, so that the yarn piecings are neither too thin nor too thick. At high rotor speeds, for example over 60,000 rpm, manual yarn piecing is in any event practically impossible.

On the other hand, package changing and yarn piecing devices which are provided for each spinning position constitute, economically overall, an expensive solution.

The economics are improved when there are employed the aforementioned travelling devices. Following an interruption at an individual spinning position, recorded by a control, such devices are, on each occasion, automatically controllably guided to that spinning position for the change operation.

The disadvantage of the last described method step lies, however, in the still relatively long waiting times of the individual spinning positions until the package change operation has been completed, particularly when several packages, which in given circumstances may be spaced apart from each other, must be almost simultaneously changed.

In order to at least partially mitigate this disadvantage, it is suggested in German Patent Publication No. 3,030,504 and the corresponding British Patent Publication No. 2,065,725, to use a length measuring device in combination with a computer unit, in order to send a package changing device to that spinning position at which the package has reached at least approximately the desired length. The length measuring device determines the yarn lengths at a number of spinning positions allocated to it and communicates these lengths continuously to the computer unit in which the length values are stored and respectively compared with the set or reference value.

When a package reaches a predetermined maximum difference in length from the set value, then the computer unit orders the movement of the package change device to this package as a precautionary measure, so that when the yarn length corresponding to the set value is reached, the package change procedure is initiated. The removal of the full package is followed by the insertion of an empty bobbin and piecing-up of the yarn end separated from the full package. The removal of the full package, the insertion of the empty bobbin, and the piecing-up of the yarn end on the empty bobbin are also concisely called "doffing", and the device which carries out this "doffing" operation is concisely called a "doffer".

The aforesaid maximum difference in length corresponds to the longest necessary travelling time of the doffer including the time for the doffing itself.

The disadvantage of this method lies in the long waiting time until the package changing procedure occurs when there prevail only short required travelling times. This disadvantage results in a severely limited frequency of package changing.

SUMMARY OF THE INVENTION

Therefore, with the foregoing in mind it is a primary object of the present invention to mitigate this disadvantage.

Another important object of the present invention is to provide a new and improved method and apparatus for the timewise optimization of operations or work at individual operating positions or stations of textile machines wherein there can be effectively determined the most efficient sequence of performing the desired operations or work at the individual operating positions.

Yet a further significant object of the present invention is directed to a new and improved construction of apparatus for optimizing as a function of time the performance of work at individual operating positions or locations of textile machines, which apparatus is relatively simple in construction and design, extremely reliable in operation, not readily subject to breakdown or malfunction and requires a minimum of maintenance and servicing.

Now in order to implement these and still further objects of the invention, which will become more readily apparant as the description proceeds, the method for the timewise optimization of an operating procedure at individual working positions or locations of textile machines where yarn packages with predetermined set yarn lengths are produced, is manifested by the features that the instananeous yarn length of each yarn package is computed and registered. Upon determination that a predetermined remainder or remnant yarn length of a package remains until carrying out a working operation a device for carrying out such working operation and movable to the working position is controllably guided to such working position with a time lead such that the travelling time of the device, even travelling through the longest way or path, is shorter than the wind-up time of the remainder yarn length. According to important aspects of the invention the respective winding times of the remainder yarn lengths of a predetermined number of packages with the respective travel times of the device from its momentary location to the working positions of the predetermined number of packages, while taking into account the time for carrying out the working operation at each of these working positions by the device, are so optimized by computation with respect to one another that there is established a favorable sequence for the working operations such that possible loss of production or quality of the yarn per spinning position is smallest.

As alluded to above, the invention is not only concerned with the aforementioned method aspects, but also relates to a novel construction of apparatus for the performance thereof. According to the invention the textile machine is provided with a length measuring unit or device which delivers to a computer unit or computer a signal for each package corresponding to the length of the already wound yarn. The computer unit serves to determine the time lead for guiding the device to the working position such that the travelling time of the device, even travelling over the longest way or path, is shorter than the wind-up time of the remainder yarn length, and which computer unit also serves to control the package changing device. According to the invention there are provided additional means for emitting a signal indicating the location of the package changing device, and the computer unit is structured such that, on the one hand, there can be determined two to five packages, the yarn length of which has reached the remainder yarn length, and, on the other hand, such computer unit also determining the most favorable sequence for performing the working operations.

The advantage achieved by the invention in comparison with the above-described state-of-the-art is essentially to be seen in that more package changes without interruption of the spinning procedure can take place as a percentage of an equal number of spinning positions than is possible with the method of the aforementioned German Patent Publication No. 3,030,504.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 shows a method according to the invention illustrated purely schematically;

FIGS. 2 and 6 respectively show a schematic representation of the time sequence.

DETAILED DESCRIPTION OF THE PREFERRED EMBODIMENTS

Figure 3:
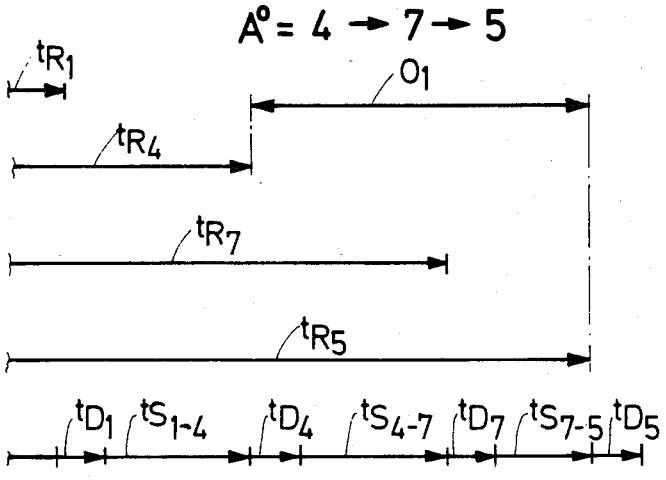
FIGS. 3–5 and 7–8 each show a schematic representation of the time sequence of the individual exemplary embodiments of the invention.

Describing now the drawings, as represented by the dot-dash line, a suitable package changer device 10 (FIG. 1) travels along a related textile machine (not further illustrated) for producing yarn packages with predetermined set yarn lengths, in order to, at a given time (as later described), after the said yarn length has been reached, exchange for empty bobbins (not shown) the full yarn packages indicated with reference numerals 1 to 8 and forming part of the wind-up process of the textile machine.

Each package 1 to 8 has associated therewith a yarn length sensing element 111 to 118, respectively, (known from the aforesaid German Patent Publication No. 3,030,504), which continually measures the length of the yarn to be wound-up and supplies to a computer unit or computer 12 a signal corresponding to this measured yarn length. Further, the position of the changer device 10 is communicated to the computer unit 12 by known position elements or position detectors 131 to 138, associated with the respective packages, for example constituted by respective end or terminal switches.

The times required for the wind-up phases, for the movement of the changer device, the waiting and the package changing are represented diagrammatically in FIGS. 2 and 6. There, t is a time required to reach the predetermined set yarn length, $t_R$ is a time required to wind-up a predetermined remainder yarn length, and $t_U$ is a waiting time of a package stopped after achieving the set yarn length until the start of the package exchange operation.

A time required for the travelled distance of the changer device 10 is indicated by $t_S$, the time required for waiting of the changer device until the package change is initiated is indicated by $t_W$, and the time required for the package change is indicated by $t_D$.

In operation, the yarn lengths sensed by the yarn sensor elements 111 to 118 are continually communicated to the computer unit or computer 12 during the production of the individual yarn packages 1 to 8.

If, by way of example, three packages are taken into consideration from the point of view of control for the time optimization of a package change, then for all packages which have reached the time region of the remainder or remnant yarn length $t_R$, the computer unit 12 compares the remaining wind-up time until the achievement of the set yarn length with the respective travelling or travel time of the changer device to these packages, and selects for the three packages that combination which overall gives for the three selected packages a shortest possible waiting time $t_U$.

EXAMPLE: FIG. (3)

As indicated diagrammatically in FIG. 3, the computer 12 has registered for the optimization $O_1$ the remainder yarn lengths $t_{R4}$, $t_{R5}$ and $t_{R7}$ of the packages 4, 5 and 7, has established in correspondence with the necessary travel distances a change sequence $A^0$ according to which the packages must be exchanged in the sequence 4, 7 and 5.

In order to explain this example, it is mentioned that the travelling time of the changer 10 from the package 1 to the package 4 is indicated with $t_{S1-4}$, from the package 4 to the package 7 with $t_{S4-7}$, and similarly between the packages 7 and 5 with $t_{S7-5}$. Furthermore, the other times relating to a specific package are provided with an index corresponding with the package number.

The expired time $t_{total}$ of the package changer in order to doff the said three packages appears mathematically in the ideal case (in which the times $t_W$ and $t_U=0$), as follows:

| | |
|---|---|
| For package 4: | |
| $t_{4total} = t_{S1-4} + t_D$ | $t_{W4} = 0$ |
| | $t_{U4} = 0$ |
| | $t_D = t_{D4}$ |
| for package 7: | |
| $t_{7total} = t_{S4-7} + t_D$ | $t_{W7} = 0$ |
| | $t_D = t_{D7}$ |
| | $t_{U7} = 0$ |
| for package 5: | |
| $T_{5total} = t_{S7-5} + t_D$ | $t_{W5} = 0$ |
| | $t_D = t_{D5}$ |
| | $t_{U5} = 0$ |
| $t_{total} = t_{S1-4} + t_{S4-7} + t_{S7-5} + 3t_D$ | |

In the normal case (FIG. 4), $t_{W4}$, $t_{W7}$ and $t_{U5}$ are not zero, but the time $t_{U5}$ is as short as possible. The times $t'_{R4}$, $t'_{R7}$ and $t'_{R5}$ differ correspondingly from the times $t_{R4}$, $t_{R7}$ and $t_{R5}$ (all in FIG. 3) and are registered or detected by the optimization $O_2$.

Figure 5:
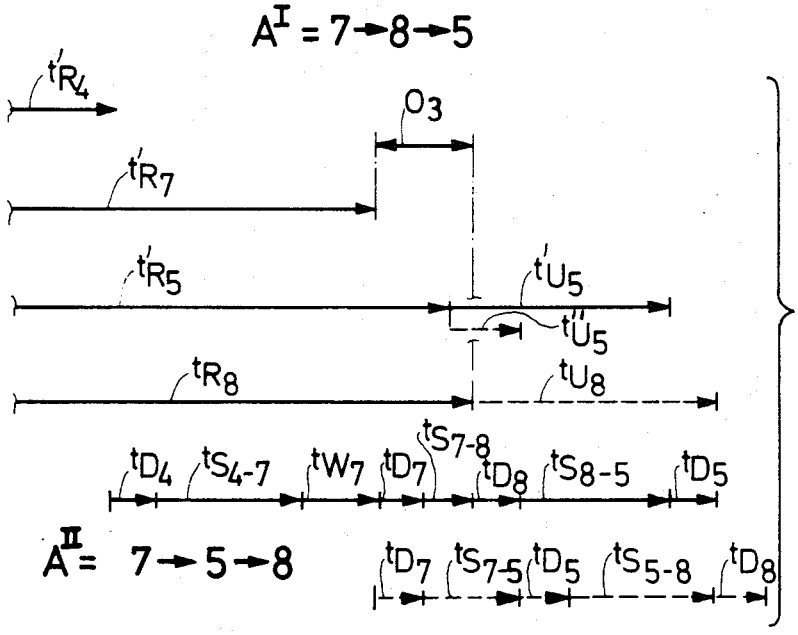

However, if the computer determines after completion of a package change that in the meantime another change sequence must be given priority, for example in order, after the change of package 7, to change not the package 5 but the still more distant package 8, then the computer 12 changes the sequence. In so doing, the computer has determined by a further optimization $O_3$ (FIG. 5) that the remainder yarn length $t_{R8}$ reaches its end so soon after the remainder yarn length $t'_{R5}$ reaches its end so soon after the remainder yarn that a new sequence $A^I$, in which the package 8 is changed after the package 7 and before the package 5, gives overall the shortest waiting time $t_U$, namely the time $t'_{U5}$. The times for these change sequences are represented in FIG. 5 with full lines.

In the same figure there is shown with dotted lines the time progression of a change sequence $A^{II}$, from which it can be seen that in such a sequence the sum of the times $t''_{U5}$ and $t_{U8}$ is greater than the time $t'_{U5}$ of the sequence $A^I$.

As a variant, the aforesaid optimization procedure can also be used for a rotor spinning machine on which the packages 1 to 8 are produced additionally with a predetermined excess length exceeding the set yarn length.

The time required for this excess length is indicated by $t_{Ue}$ (FIG. 6).

The waiting time $t_U$, which follows immediately this time $t_{Ue}$ required for the excess length, is the intervening time after stopping of the package, that is after expiration of the time $t_{Ue}$, until exchange of the package and re-piecing of the thread, whether manually or mechanically.

Figure 7:
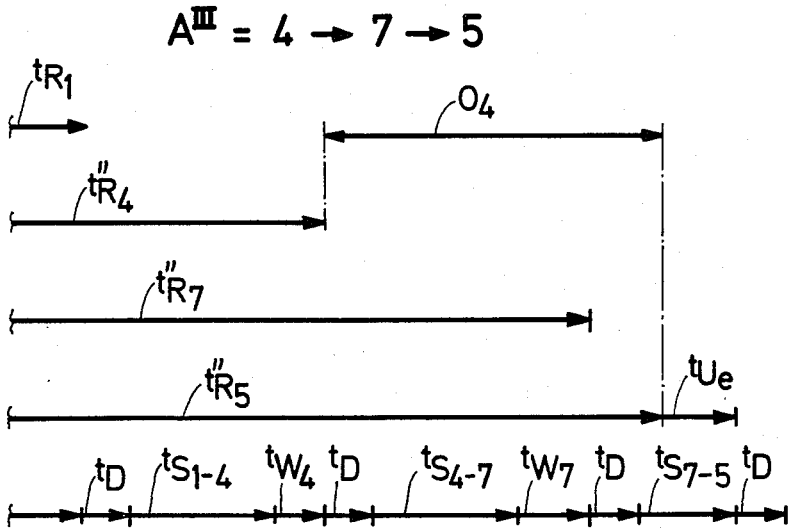

In operation of this variant, for all packages which have reached the time region of the remainder yarn length $t_R$, a computer 121 (FIG. 1) compares the remainder wind-up time up to and including the time $t_{Ue}$ for the achievement of the maximum excess length with the respective travelling times of the changer device to these packages, and selects for three packages that combination which overall gives for the three selected packages a shortest possible time $t_{Ue}$. An example of such a variant is shown in FIG. 7, in which a package changer 101, starting from the position shown in FIG. 1, changes one after another the packages 4, 7 and 5 corresponding to the change sequence $A^{III}$.

For this, the optimization $O_4$ has procedurally established the remainder yarn length $t''_{R4}$, $t''_{R7}$ and $t''_{R5}$ in such a manner that the packages 4 and 7 are produced without excess lengths and the package 5 is produced with an excess length.

Figure 8:
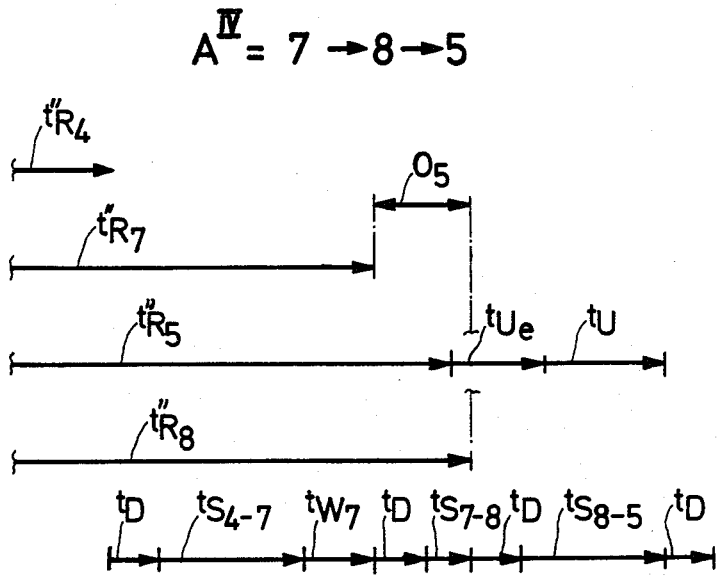

In the example illustrated in FIG. 8, a new change priority is selected by the computer 121 after the change of the package 4, in order, in accordance with an exchange sequence $A^{IV}$, after the change of the package 7, to exchange first the package 8 and thereafter the package 5. This exchange sequence is determined procedurally by the optimization $O_5$.

From FIG. 8 it can be seen that the packages 7 and 8 are exchanged without excess lengths, whereas the package 5, after reaching the excess length, is stopped by a length measuring unit forming part of the register or storage until the exchange of the package, that is during a waiting time $t_U$. The time $t_U$ is limited by a subsequent manual or mechanical change of the package of the corresponding spinning position.

With manual exchange of the packages, the computer 121 additionally initiates an indication after expiration of the time $t_{Ue}$ for this corresponding winding position, and excludes this winding position temporarily from the optimization program. Re-inclusion in the optimization program occurs, for example, through a manual signal emission (not shown) by the attendant after change of the package and piecing of the thread at the corresponding spinning position. The expression "piecing of the thread" covers both piecing to a new package with uninterrupted spinning process at this spinning position, or new start-spinning after an interrupted spinning process.

A further variant of the use of the optimization procedure consists in optimizing the times of cleaning of the rotors of the individual spinning positions after the stopping of the spinning positions by means of a yarn length measuring unit forming part of a computer 122.

Figure 4:
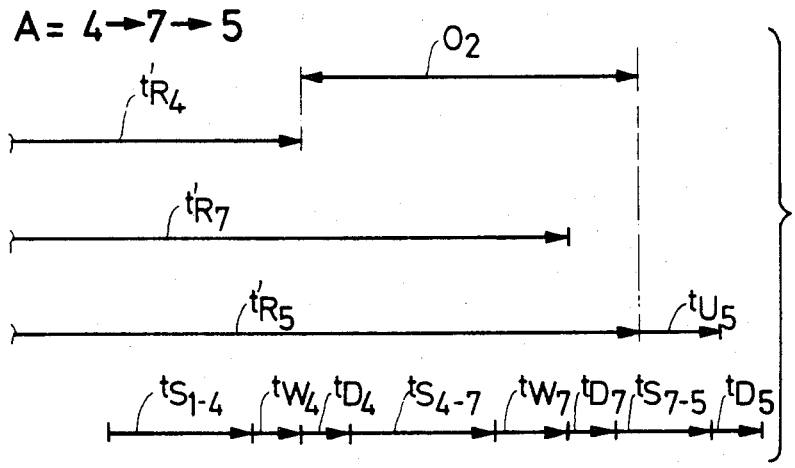

The optimization procedure then operates in accordance with the variant illustrated and described with reference to FIGS. 2, 4 and 5.

The registered times $t_R$ of the remainder yarn lengths correspond to the remainder yarn length before the time of the cleaning, and the waiting times $t_U$ are waiting times after stopping of the spinning process per spinning position until the time of the cleaning. After completion of the optimization process for the cleaning of the rotors, there comes into operation the already described optimization procedure for the package exchange or possibly, simultaneously with the package exchange, also for the repeated cleaning of the rotors during exchange and for the new start-spinning.

A second variant of the use of the optimization procedure for the cleaning of the rotors of the individual spinning positions consists in that the cleaning occurs within a time period following immediately a predetermined set time for the cleaning, for example after the half-set yarn length is reached. For this, the optimization procedure selects, for example, three spinning positions whose wind-up times lie within a time $t_R$ of a remainder yarn length before achieving the aforesaid set time.

This optimization procedure operates substantially in accordance with the variant illustrated and described with reference to FIGS. 6 and 7. There, the end of the time $t_R$ corresponds to the set time for the cleaning of the rotor, and the time $t_{Ue}$ shown in FIG. 7 corresponds to the time range within which the rotor cleaning must occur. After expiration of the time $t_{Ue}$ the spinning position is stopped for the time $t_U$. The rotor is cleaned before spinning is re-started.

As already mentioned for the first cleaning variant, after completion of this optimization procedure there comes into operation the optimization procedure for the package changing operation or possibly, simultaneously with the package changing, also for the repeated cleaning of the rotor during changing and for the new start-spinning.

The intervals shown in FIGS. 2 to 8 corresponding to the different times are not according to scale. By way of example, the changer 10; 101 has a speed of travel which permits it to travel past 200 spinning positions in 2.5 minutes and requires for the package changing, cleaning and new start-spinning a time of 20 to 30 seconds.

The claimed method is, on the other hand, not limited only to use for the changing of packages on rotor spinning machines. It is basically usable for all textile machines in which yarn packages are to be produced with predetermined set yarn lengths and in which the packages, after reaching this set yarn length, are changed by a device guided to the working or operating position.

The invention therefore also relates to a textile machine with a plurality of working positions, a travelling service apparatus, a travel path for the apparatus and a control device. The machine is provided with a data transmission system to transmit operating condition data from the working positions to the control device, location or position data from the service apparatus to the control device, and control data from the control device to the service apparatus. The operating condition data represent the operating conditions of the individual working positions, and the location data represent the location of the service or servicing apparatus relative to the working position. The control data control the movements of the service apparatus along the travel path. The control device is so arranged that the control data are produced corresponding to the received operating condition and location or positional data.

The invention further relates to a control method for a textile machine with a plurality of working positions, a travelling service apparatus, a travel path for the apparatus and a control device. The operating conditions of the various working positions and the location of the service apparatus relative to the working positions can be determined and transmitted as data to the control device. The movements of the service apparatus along the travel path can be controlled by the control device in dependence upon the determined operating conditions and location.

The textile machine could be, for example, an open-end spinning machine, a ring spinning machine or a winding machine. The determined operating conditions could be running times and/or normal operation/fault and/or "full package" (wound yarn lengths). The control device can be so arranged that the movements of the service apparatus are optimized according to a program. The optimizing criteria of the program can represent or at least take into account the minimum total time for the operating procedures of the service apparatus, pre-programmed service operation on a plurality of working positions being included under the expression "operating procedures".

While there are shown and described present preferred embodiments of the invention, it is to be distinctly understood that the invention is not limited thereto, but may be otherwise variously embodied and practiced within the scope of the following claims. Accordingly,

What I claim is:

1. A method of time optimization in the operation of a textile machine comprising a predetermined number of working positions at each one of which a yarn is wound up in a winding operation in order to produce an associated yarn package of a predetermined set yarn length, and a working device traveling between the working positions for carrying out predetermined working operations at individual ones of said working positions, said method comprising the steps of:

determining and registering the instantaneous yarn length wound up at each yarn package while winding up thereon said yarn;

detecting at each one of said yarn packages a predetermined remainder yarn length which completes the predetermined set yarn length and said associated yarn package;

selecting a number of yarn packages at which said predetermined remainder yarn length has been detected and, while continuing the winding operation at said selected number of yarn packages, determining for each one of said selected number of yarn packages a remaining wind-up time required for winding up the remaining yarn length of the related predetermined set yarn length at the associated yarn package;

determining a momentary position of said working device, and further ascertaining:

(i) a working time required for said working device to perform said working operation at each said working positions at which an associated yarn package is produced, and (ii) the traveling time of said working device from said momentary position thereof to each one of a selected number of working positions with each one of which a related one of said selected number of yarn packages is associated; and comparing said traveling times plus said working times required by said working device for performing said working operations at said selected number of working positions with said remaining wind-up times determined for each one of said selected number of associated yarn packages and, as a result of such comparison, controllably guiding said working device from said momentary position thereof to said selected number of working positions in a working sequence which results in a minimum total loss of yarn length or yarn quality, while said working operations are carried out at all of the selected number of working positions.

2. The method as defined in claim 1, further including the steps of:

selecting as said textile machine a spinning machine performing a spinning operation and comprising, as said working positions, a predetermined number of spinning positions at each one of which a yarn is wound up in order to produce the associated yarn package of the predetermined set yarn length;

using as said working device a package changing device traveling between said spinning positions for carrying out, as said predetermined working operations, package changing operations at individual ones of said spinning positions;

defining for each one of said yarn packages a predetermined excess yarn length by which said predetermined set yarn length is exceeded;

ascertaining for each one of said yarn packages an excess wind-up time required for winding up said predetermined excess yarn length;

the step of selecting said number of yarn packages and of determining for each one of said selected number of yarn packages said remaining wind-up time, entailing the step of determining said remaining wind-up time plus the related excess wind-up time;

the step of determining said momentary position of said working device, entailing the step of determining the momentary position of said package changing device and further ascertaining:

(i) as said working time, a changing time required for said package changing device to perform said package changing operation at each one of said spinning positions at which a related one of said associated yarn packages is produced, and (ii) the traveling time of said package changing device from said momentary position thereof to each one of a selected number of spinning positions with each one of which a related one of said selected number of yarn packages is associated; and the step of comparing said traveling and working times required by said working device and controllably guiding the same, entailing the step of comparing said traveling times plus said changing times required by said package changing device for said package changing operations at said selected number of spinning positions with said remaining wind-up times plus said excess wind-up times determined for each one of said selected number of associated yarn packages and, as a result of such comparison, controllably guiding said package changing device from said momentary position thereof to said selected number of spinning positions in a package changing sequence which results in a minimum total excess yarn length, which constitutes said minimum total loss of yarn length, while said package changing operations are carried out at all of said selected spinning positions.

3. The method as defined in claim 2, further including the step of:

interrupting the spinning operation at each one of said selected number of yarn packages at which said predetermined excess yarn length has been wound up.

4. The method as defined in claim 2, wherein:

the step of selecting said spinning machine includes the step of selecting a rotor spinning machine in which said package changing device carries out, in addition to said package changing operations, a new start-spinning operation at individual ones of said spinning positions;

said step of ascertaining the changing time required for said package changing device and the traveling time of said package changing device from said momentary position thereof, includes the step of further determining a time period which elapses between the interruption and the new start-spinning operation at each one of said selected number of spinning positions; and the step of comparing said traveling times plus said changing times required by said package changing device for said package changing operations at said selected number of spinning positions with said remaining wind-up times plus said excess wind-up times determined for each one of said selected number of associated yarn packages additionally includes taking into account the elapsed time periods required by said package changing device until said new start-spinning operations at said selected number of spinning positions, and the step of, as a result of such comparison, controllably guiding said package changing device includes the step of controllably guiding said package changing device from said momentary position thereof to said selected number of spinning positions in a package changing sequence which results in a minimum total of elapsed time periods, which represents said minimum total loss of yarn length, while said package changing operations are carried out at all of said selected spinning positions.

5. The method as defined in claim 1, further including the steps of:

selecting as said textile machine a spinning machine performing a spinning operation and comprising, as said working positions, a predetermined number of spinning positions at each one of which a yarn is wound up in order to produce the associated yarn package of the predetermined set yarn length;

using as said working device a package changing device traveling between said spinning positions for carrying out, as said predetermined working operations, package changing operations and a new start-spinning operation at individual ones of said spinning positions;

in the step of determining said momentary position of said working device, determining the momentary position of said package changing device and further ascertaining:

(i) as said working time, a changing time required for said package changing device to perform said package changing operation at each one of said spinning positions at which a related one of said associated yarn packages is produced, (ii) the traveling time of said package changing device from said momentary position thereof to each one of a selected number of spinning positions with each one of which a related one of said selected number of yarn packages is associated, and (iii) a time period which elapses between the interruption and the new start-spinning operation at each one of said selected number of spinning positions; and in the step of comparing said traveling and working times required by said working device and controllably guiding the same, comparing said traveling times plus said changing times plus said elapsed time periods required by said package changing device and until said new start-spinning operation at said selected number of spinning positions, with said remaining wind-up times determined for each one of said selected number of associated yarn packages and, as a result of such comparison, controllably guiding said package changing device from said momentary position thereof to said selected number of spinning positions in a package changing sequence which results in a minimum total of elapsed time periods which represents said minimum total loss of yarn length, while said package changing operations are carried out at all of said selected spinning positions.

6. The method as defined in claim 1, further including the steps of:

selecting as said textile machine a spinning machine performing a spinning operation and comprising, as said working positions, a predetermined number of spinning positions at each one of which a yarn is wound up on a related rotor in order to produce thereon the associated yarn package of a predetermined set yarn length;

using as said working device a package changing device traveling between said spinning positions for carrying out, as said predetermined working operations, package changing operations at individual ones of said spinning positions;

prior to detecting at each one of said yarn packages the predetermined remainder yarn length, performing the following steps:

(i) detecting at each one of said yarn packages a predetermined yarn length which is shorter than said predetermined set yarn length and which defines a predetermined stopping time for stopping the spinning operation prior to carrying out a cleaning operation at each related rotor;

(ii) detecting at each one of said yarn packages a further predetermined remainder yarn length which completes the related predetermined yarn length at said yarn package;

(iii) selecting a number of spinning positions with which yarn packages are associated at which said further predetermined remainder yarn length has been detected;

(iv) stopping the spinning operation at said predetermined stopping time, thereafter carrying out said cleaning operation at said rotor and then performing a new start-spinning operation at each one of said selected number of spinning positions;

(v) determining a waiting time which elapses between said stopping of the spinning operation and the start of said cleaning operation at said rotor at each one of said selected number of spinning positions; and (vi) comparing the total of said waiting times for different cleaning sequences at said rotors of said selected number of spinning positions and selecting, as a result of such comparison, a cleaning sequence which yields a minimum total waiting time for all of the selected number of spinning positions.

7. The method as defined in claim 6, wherein:

said step of detecting at each of said yarn packages the predetermined yarn length which is shorter than said predetermined set yarn length and which defines said predetermined stopping time for stopping the spinning operation prior to carrying out said cleaning operation, entails the step of selecting a predetermined yarn length which is equal to approximately half of said predetermined set yarn length.

8. The method as defined in claim 1, further including the steps of:

selecting as said textile machine a spinning machine performing a spinning operation and comprising, as said working positions, a predetermined number of spinning positions at each one of which a yarn is wound up on a related rotor in order to produce thereon the associated yarn package of the predetermined set yarn length;

using as said working device a package changing device traveling between said spinning positions for carrying out, as said predetermined working operations, package changing operations at individual ones of said spinning positions;

prior to detecting at each of said yarn packages the predetermined remainder yarn length, performing the following steps:

(i) detecting at each one of said yarn packages a predetermined yarn length which is shorter than said predetermined set yarn length and which defines a predetermined stopping time for stopping the spinning operation prior to carrying out a cleaning operation at each related rotor;

(ii) defining for each one of said yarn packages a predetermined differential yarn length by which the related yarn length differs from said predetermined set yarn length;

(iii) determining for each one of said yarn packages a differential wind-up time required for winding up said predetermined differential yarn length;

(iv) detecting at each of said yarn packages a further predetermined remainder yarn length which completes the related predetermined yarn length at said yarn package;

(v) selecting a number of spinning positions with which yarn packages are associated at which said further predetermined remainder yarn length has been detected;

(vi) stopping the spinning operation at said predetermined stopping time plus said differential wind-up time required for winding up said predetermined differential yarn length, thereafter starting said cleaning operation and then carrying out a piecing operation in order to perform a new start spinning operation at each one of said selected number of spinning positions; and (vii) comparing the total of said differential times elapsing from said predetermined stopping time to said starting of the cleaning operation for different cleaning sequences of said selected number of spinning positions and, as a result of such comparison, selecting a cleaning sequence which yields a minimum total of differential wind-up times, which represents said minimum total loss of yarn quality, for all of the selected number of spinning positions.

9. The method as defined in claim 8, wherein:

said step of detecting at each one of said yarn packages the predetermined yarn length which is shorter than said predetermined set yarn length and which defines said predetermined stopping time for stopping the spinning operation prior to carrying out said cleaning operation, entails the step of selecting a predetermined yarn length which is equal to approximately half of said predetermined set yarn length.

10. The method as defined in claim 8, wherein:

the step of defining for each one of said yarn packages a predetermined differential yarn length by which the related yarn length differs from said predetermined set yarn length, entails the step of selecting a differential yarn length amounting to approximately one-tenth of said predetermined set yarn length.

11. The method as defined in claim 1, wherein:

the predetermined set yarn length is not undershot.

12. The method as defined in claim 1, wherein:

the step of controllably guiding said working device from said momentary position thereof to said selected number of working positions entails the step of controllably guiding said working device from said momentary position thereof to said selected number of working positions with a time lead at each one of said selected number of working positions; and selecting said time lead so that said remaining wind-up time is in the range of approximately one to three times the traveling time between widest spaced working positions.

13. The method as defined in claim 12, wherein:

said time lead is selected so that said remaining wind-up time amounts to approximately twice the traveling time between the widest spaced working positions.

14. The method as defined in claim 1, further including the steps of:

selecting as said textile machine a spinning machine comprising, as said working positions, a predetermined number of spinning positions;

using as said working device a predetermined number of package changing devices each of which is associated with a range of about 150 to 200 such spinning positions; and in the step of selecting a predetermined number of yarn packages at which said predetermined remainder yarn length has been detected, selecting two to five yarn packages.

15. The method as defined in claim 14, wherein:

in the step of selecting a predetermined number of yarn packages at which said predetermined remainder yarn length has been detected, selecting four yarn packages of a group containing about 180 spinning positions.

16. An apparatus for time-optimization in the operation of a textile machine comprising:

a predetermined number of yarn packages arranged at a predetermined number of working positions at each one of which a yarn is wound-up in a winding operation in order to produce an associated yarn package of a predetermined set yarn length;

a working device travelling between said predetermined number of working positions for carrying out predetermined working operations at individual ones of said predetermined number of working positions;

length measuring means determining the instantaneous length of the already wound-up yarn on each one of said predetermined number of yarn packages;

a computer operatively associated with said length measuring means;

said length measuring means generating signals corresponding to said instantaneous length of the already wound-up yarn on each one of said predetermined number of yarn packages and delivering said signals to said computer;

indicating means emitting a signal indicating the momentary position of said working device and operatively associated with said computer;

said computer registering the signals indicating said instantaneous yarn length and determining, at each one of said predetermined number of yarn packages, a predetermined remainder yarn length which completes the predetermined set yarn length;

said computer determining, for a pre-selected number of said predetermined number of yarn packages at which said predetermined remainder yarn length has been determined and on the basis of said momentary position of said working device indicated by said signal emitted by said indicating means, (i) a working time required for said working device to perform said predetermined working operation at each one of said pre-selected number of yarn packages, (ii) a travelling time of said working device from said momentary position thereof to each one of a pre-selected number of working positions which correspond to the working positions of said pre-selected number of yarn packages, (iii) a remaining wind-up time required for winding-up the remaining yarn length of the predetermined set yarn length at each one of said pre-selected number of yarn packages; and said computer containing comparison means comparing said travelling times plus said working times of said working device at said pre-selected number of working positions, with said remaining wind-up times at each one of said pre-selected number of yarn packages and, as a result of such comparison, controllably guiding said working device from said momentary position thereof to said pre-selected number of working positions in a working sequence which results in a minimum total loss of yarn length or yarn quality, while said working operations are carried out at all of the pre-selected number of yarn packages.

17. The apparatus as defined in claim 16, wherein:

said pre-selected number of yarn packages comprises two to five yarn packages of said predetermined number of yarn packages.

18. The apparatus as defined in claim 16, wherein:

said textile machine constitutes a spinning machine and said predetermined number of working positions constitutes a predetermined number of spinning positions; and said working device constitutes a package changing device and said predetermined working operation constitutes a package changing operation.

19. The apparatus as defined in claim 16, wherein:

said computer controllably guides said working device from said momentary position thereof to said pre-selected number of working positions with a time lead selected such that said remaining wind-up time is in the range of approximately one to three times the travelling time between the widest spaced ones of said pre-selected number of working positions.

* * * * *